US005632801A

United States Patent [19]

Lin

[11] Patent Number: 5,632,801

[45] Date of Patent: May 27, 1997

[54] PROCESS FOR MAKING METAL-MATRIX COMPOSITES MIXED WITH REINFORCING MATERIALS BY FORCED DRAFTING

[75] Inventor: Ching-Bin Lin, Taipei, Taiwan

[73] Assignee: Loyalty Founder Enterprise Co., Ltd., Taoyuan, Taiwan

[21] Appl. No.: 322,455

[22] Filed: Oct. 11, 1994

[51] Int. Cl.[6] ..... C21D 10/00

[52] U.S. Cl. ..... 75/708; 75/684; 148/538; 148/549; 420/590

[58] Field of Search ..... 75/684, 708; 148/538, 148/437, 549; 420/590

[56] References Cited

U.S. PATENT DOCUMENTS 5,167,920 12/1992 Skibo ..... 420/548

5,401,338 3/1995 Lin ..... 148/538

*Primary Examiner*—Melvyn Andrews

[57] ABSTRACT

A process for making metal-matrix composites includes: purging a refining chamber filled with molten metal matrix in a furnace by an inert gas such as nitrogen gas; filling a reinforcing material, preferably with particulates, in a bucket suspended above the molten metal matrix filled in the furnace; applying a forced drafting on the reinforcing material in the bucket for subsequently upwardly drafting the reinforcing material from the bucket; and downwarddly forcing the uprising reinforcing material to be homogeneously distributed into the molten metal matrix under homogeneous agitation, for producing a metal-matrix composite reinforced with reinforcing material in a closed system wherein the nitrogen gas is served merely for Initially purging the air outwardly from the system, not being consumed continuously in order for greatly saving the nitrogen consumption and reducing the production cost thereof.

11 Claims, 5 Drawing Sheets

PROCESS FOR MAKING METAL-MATRIX COMPOSITES MIXED WITH REINFORCING MATERIALS BY FORCED DRAFTING

BACKGROUND OF THE INVENTION

U.S. patent application entitled "Process for making metal-matrix composites reinforced by ultrafine reinforcing materials" of U.S. Ser. No. 08/103,049 filed on Jul. 28, 1993, now U.S. Pat. No. 5,401,338 which is also invented by the same inventor of this application, disclosed a process for making metal-matrix composites by spraying or atomizing a suspension liquid containing the ultrafine reinforcing material into the molten metal matrix by using an inert gas of nitrogen.

The nitrogen inert gas is greatly consumed in such a conventional process under the circumstances as follows:

1. The nitrogen gas is used to help agitate the suspension liquid containing the reinforcing material before being charged to the molten metal.

2. The nitrogen should be continuously applied into the nozzle for spraying or atomizing the suspension liquid onto the molten metal solution.

3. The process is continuously blanketed with nitrogen.

Therefore, the great consumption of nitrogen in such a conventional process will increase a production cost of the composite products and will thus decrease its commercial value.

SUMMARY OF THE INVENTION

The object of the present invention is to provide a process including: purging a refining chamber filled with molten metal matrix in a furnace by an inert gas such as nitrogen gas; filling a reinforcing material, preferably with particulates, in a bucket suspended above the molten metal matrix filled in the furnace; applying a forced drafting on the reinforcing material in the bucket for subsequently upwardly drafting the reinforcing material from the bucket; and downwardly forcing the uprising reinforcing material to be homogeneously distributed into the molten metal matrix under homogeneous agitation, for producing a metal-matrix composite reinforced with reinforcing material in a closed system wherein the nitrogen gas is served merely for initially purging the air outwardly from the system, not being consumed continuously in order for greatly reducing the production cost thereof.

DETAILED DESCRIPTION

Figure 1:
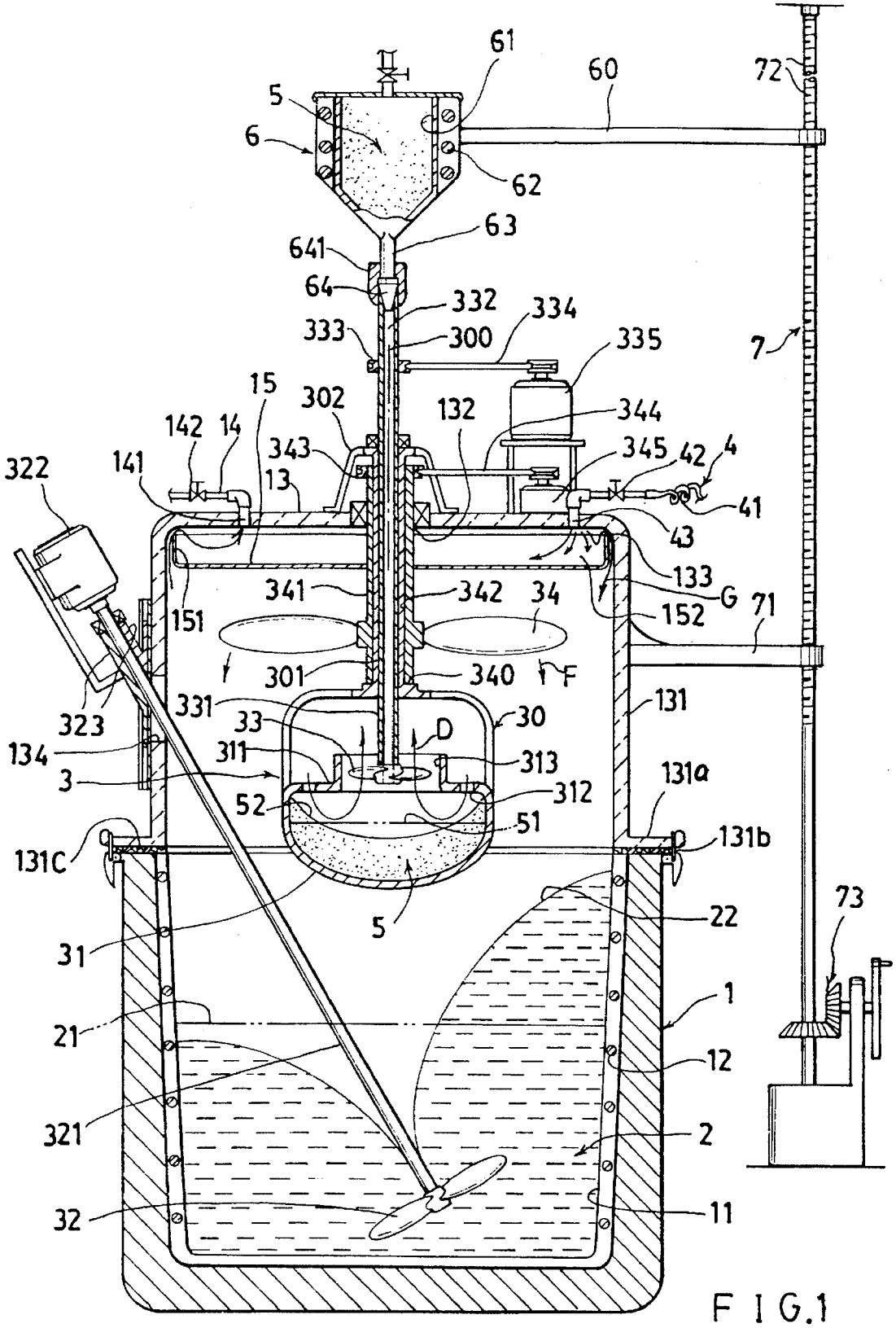
FIG. 1 is a sectional drawing showing a systematic equipment and its operation for making particulate-reinforced metal-matrix composite in accordance with the present invention.
Figure 2:
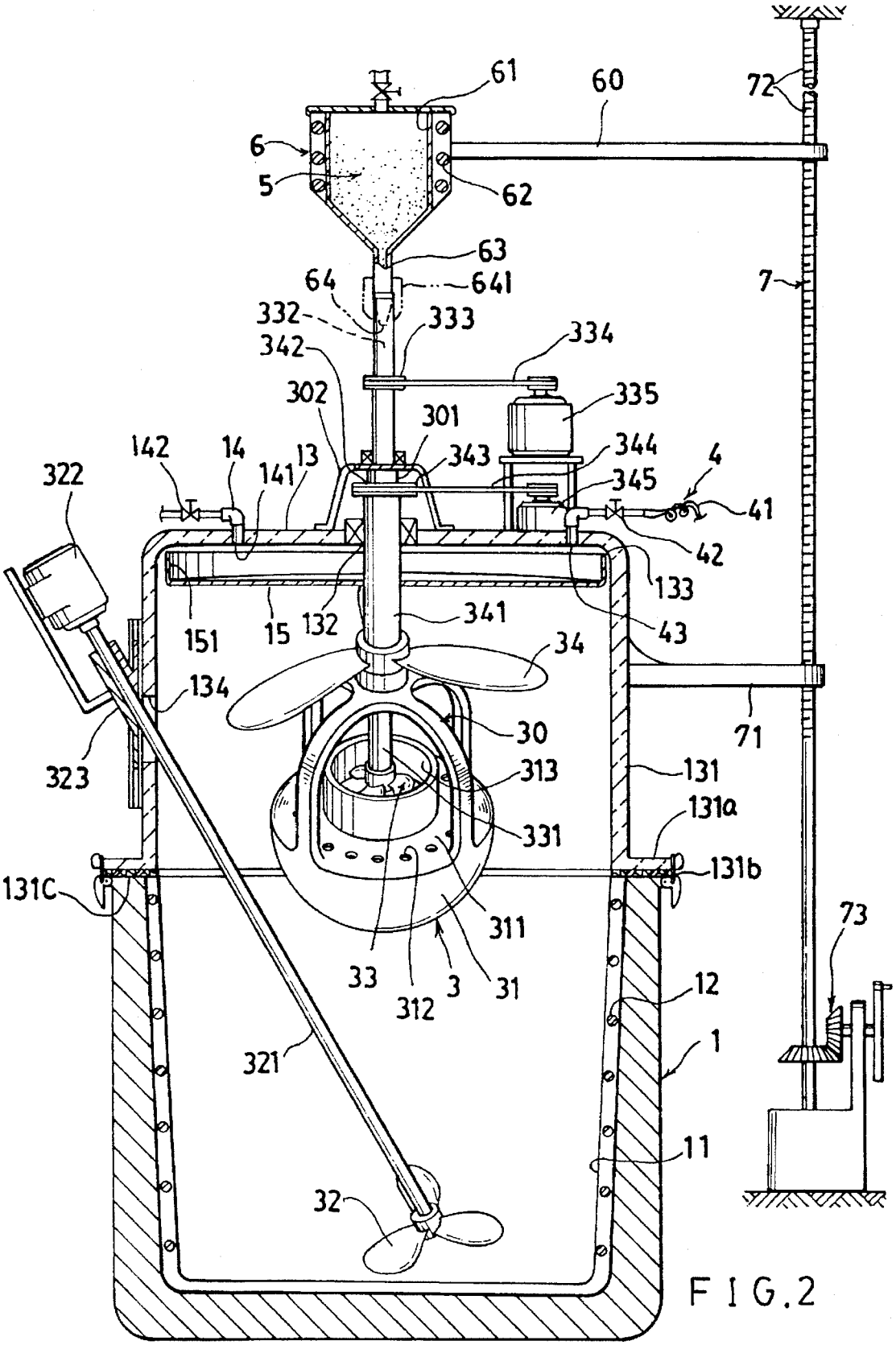
FIG. 2 is an illustration showing a systematic equipment of the present invention including partial perspective view of a feeding and agitating means.

As shown in FIGS. 1 and 2, an apparatus for making the metal-matrix composites of the present invention comprises: a heating furnace 1 filled with molten metal matrix 2 such as aluminum alloy in the furnace 1, a suspending bucket 31 mounted in the furnace 1, a feeding and agitating means 3 mounted in the furnace 1, an inert gas supply means 4, a reinforcing material charger 6 for supplying reinforcing material 5 into the suspending bucket 31, and a mounting frame 7 for adjustably detachably mounting the related elements of the present inventon.

The heating furnace 1 includes: a refining chamber 11 surrounded by a heating medium 12 which may be an electric heating coil or other heating media for heating the molten metal matrix 2 filled in the refining chamber 11, a heat-insulative or ceramic cover 13 having a cylindrical wall 131 protruding downwardly from the cover 13 and a lower flange 131a formed on a lower edge of the cylindrical wall 131 to be detachably fastened en a top opening of the refining chamber 11 in the furnace 1 by a plurality of fasteners **131*b* and sealed by a heat-insulative packing or ceramic wool 131*c*, an inlet port 43 of the inert gas supply means 4 formed in the cover 13 for directing inert gas (G) such as nitrogen into the refining chamber 11 through an arcuate periphery 133 inside the cover 13 from an inert gas hose 41 having a gas valve 42 formed thereon, and a venting pipe 14 having a venting valve 142 formed thereon and communicating with a discharge port 141 formed in the cover 13** for discharging air outwardly as purged by the inert gas.

The feeding and agitating means 3 includes: a vortex agitator 32 rotatably mounted on the heat-insulative cover 13 and protruding downwardly to approximate a bottom of the refining chamber 11 for agitating the molten metal matrix 2 in the furnace 1, an upwardly-drafting propeller 33 rotatably mounted in the furnace 1 and positioned at a central portion of the bucket 31 for upwardly divergently drafting (D) the reinforcing material 5 which may be formed as particulates, whiskers or short fibers and are preferably particulates, from inside the bucket 31, and a downwardly-blowing propeller 34 rotatably mounted in the furnace 1 above the bucket 31 and adjacent to the cover 13 for downwardly forcing (F) the reinforcing material 5 uprisen from the bucket 31 to be homogeneously distributed into the molten metal matrix 2 in the refining chamber 11 to mix the reinforcing material 5 with the metal matrix as agitated by the vortex agitator 32.

The vortex agitator 32 includes: a plurality of propeller blades radially secured to a lower end of an agitator shaft 321 protruding downwardly to a bottom of the refining chamber 11 from an agitator motor 322 mounted on the cover 13 and through a side hole 134 slotted in the cover 13, and a bushing 323 combined by a pair of semi-cylindrical bands slidably held on a cylindrical wall 131 of the cover 13 for rotatably disposing the agitator shaft 321 in the bushing 323, whereby upon rotation of the vortex agitator 32, a vortex 22 will be formed from a horizontal level 21 of the molten metal matrix 2 and a heat convection will be formed for efficiently agitating the matrix 2 to be homogeneously mixed with the reinforcing material 5.

The suspending bucket 31 generally cylindrical or bowl shaped includes: an annular shoulder portion 311 having a plurality of suction holes 312 formed in the annular shoulder portion 311 and formed on an upper portion of the bucket 31, a central duct 313 protruding upwardly from the shoulder portion 311 for upwardly guiding (D) an inert gas (nitrogen) streamflow laden with reinforcing material thereon when the upwardly-drafting propeller 33 is driven for sucking inert gas streamflows from the suction holes 312 inwardly into the bucket 31 to carry the reinforcing material 5 to be laden on the inert gas streamflow and for upwardly drafting the inert gas streamflow carrying the reinforcing meterial 5 through the central duct 313, and a hanging bracket 30 having a lower bracket portion of the hanging bracket 30 secured with the shoulder portion 311 and having an upper bracket portion of the bracket 30 secured to a suspending sleeve 301 protruding upwardly through the cover 13 and secured to the cover 13 by a fixing bracket 302 which may be trifurcated or branched supporting members fixed on the cover 13 for passing (or without obstructing) a transmission belt 344 for operating the downwardly-blowing propeller 34.

The upwardly-drafting propeller 33 includes: a plurality of upwardly-curved propeller blades radially secured to a lower shaft end of a central hollow shaft 331 rotatably mounted in a central sleeve hole longitudinally formed through the suspending sleeve 301 of the suspending bucket 31 and having a central feeding passage 332 longitudinally formed through the central hollow shaft 331 for communicating with the suspending bucket 31 and the reinforcing-material charger 6, and a central follower pulley 333 secured on an upper portion of the central hollow shaft 331 and coupled to a central-shaft driving motor 335 by a shaft transmission belt 334 wound between the central follower pulley 333 and the central-shaft driving motor 335 which is mounted on the cover 13, whereby upon rotation of the upwardly-drafting propeller 33 as driven by the central-shaft driving motor 335, an inert gas streamflow carrying the reinforcing material 5 will be drafted upwardly (D) as shown in FIG. 1 and then forced downwardly by the downwardly-blowing propeller 34.

The downwardly-blowing propeller 34 includes: a plurality of downwardly curved propeller blades radially secured to a hollow sleeve 341 having an inner through hole 342 rotatably engageable with the hanging sleeve 301 of the suspending bucket 31 and having an outer sleeve surface rotatably engageable with a central hole 132 formed in the cover 13, with a lower sleeve end 340 rotatably engageable with an upper portion of the hanging bracket 30 of the bucket 31, and a follower pulley 343 secured on an upper portion of the hollow sleeve 341 and coupled to a hollow-sleeve driving motor 345 by a sleeve transmission belt 344 wound between the follower pulley 343 and the hollow-sleeve driving motor 345 which is mounted on the cover 13, whereby upon rotation of the downwardly-blowing propeller 34 as driven by the hollow-shaft driving motor 345, an inert gas streamflow carrying the reinforcing material 5 as uprisen from the bucket 31 will be forced downwardly (F) to homogeneously distribute or disperse the reinforcing material into the molten metal matrix 2.

The hollow sleeve 341 is secured with a buffling disk 15 on an upper portion of the hollow sleeve 341 adjacent to the cover 13 and above the downwardly-curved propeller blades of the downwardly-blowing propeller 34, having a shallow cylindrical flange 151 bent upwardly to form an inert-gas chamber 152 adjacent to an inlet port 143 of an inert gas supply means 4 for forming a pressurized inert gas atmosphere in the inert-gas chamber 152 for precluding an upward and outward leakage of the reinforcing material 5 from the refining chamber 11 through the central hole 132 in the cover 13.

Both the upwardly-drafting propeller 33 and the downwardly-blowing propeller 34 are aligned and concentric about a longitudinal axis 300 at a longitudinal center of the suspending bucket 31 for a smooth rotation of the propellers 33, 34. All rotating parts or elements may be provided with O-rings or packings to prevent gas or material leakage from the closed system of the present invention.

Figure 1A:
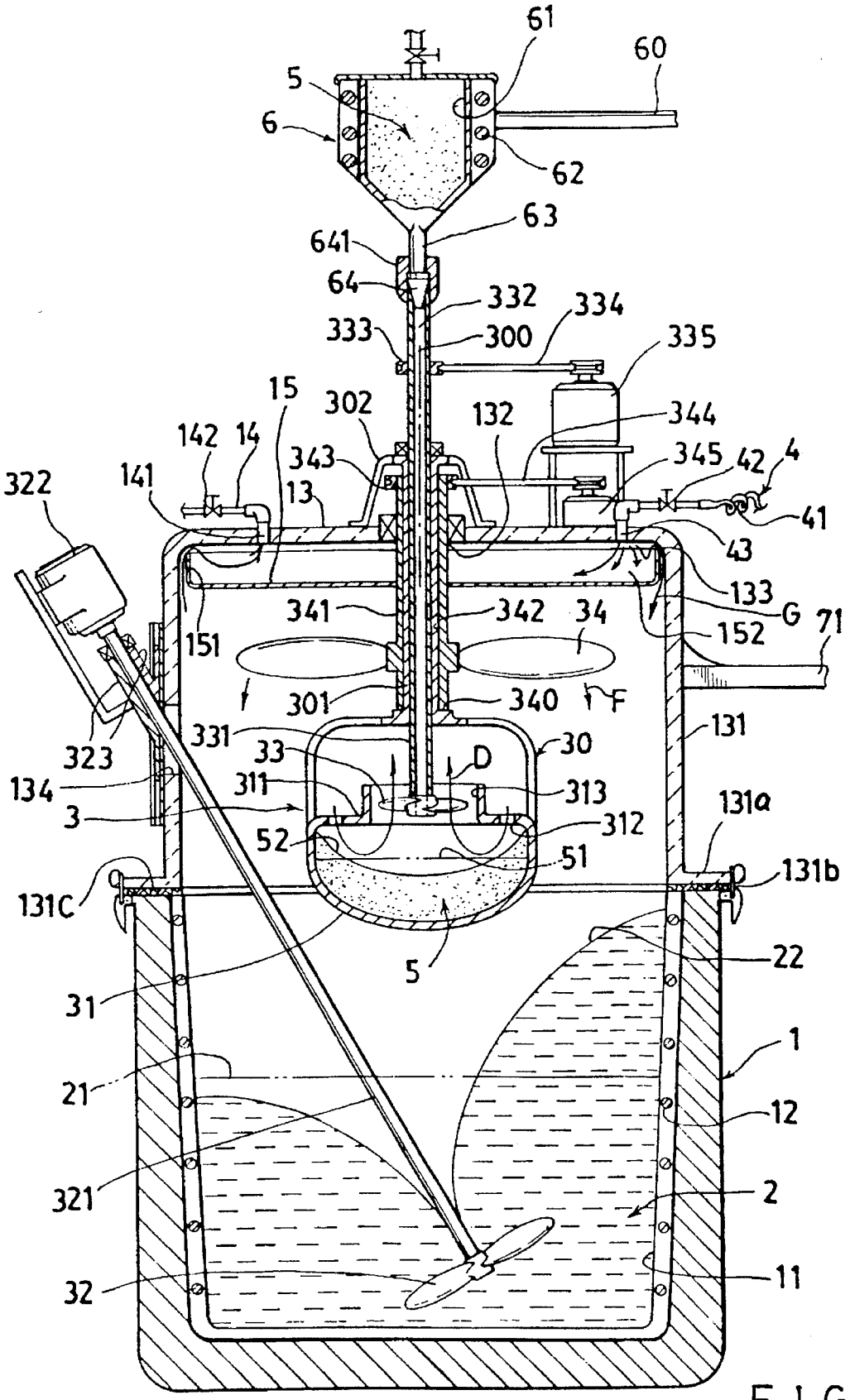
FIG. 1A is derived from FIG. 1 without showing the mechanism of mounting frame.

The driving motors 335,345 and 322 are mounted on the cover 13 which is secured on a mounting bracket 71 movably or adjustably securable to a guiding post 72 of an elevating (or descending) means 73 of the mounting frame 7. Naturally, other cranes or handling machines may be provided for detachably mounting the cover 13 on the furnace 1. When finishing each batch refining process of the present invention, the cover 13 and all other equipments mounted or attached thereto may be elevated for re-filling the raw material, or other operational or maintenance jobs. The elevating means 73 may be selected from any conventional mechanisms, such as electrically operated, hydraulically driven or even manually actuated, not limited in this invention. As shown in FIG. 1A, the cover 13 and the linking member 13 may be secured to other mounting frames (not shown) for lifting or descending the motor on the cover 13 and the charger 6 by any conventional mechanisms and methods, not limited in this invention.

The reinforcing-material charger 6 includes: a container 61 adjustably mounted by a linking arm member 60 on the mounting frame 7 for storing the reinforcing material 5 therein, a preheating device 62 disposed around the container 61 for preheating the reinforcing material 5 stored in the container 61, a feeding pipe 63 protruding downwardly from the container 61 to connect a nozzle 64 secured at a lowest end of the feeding pipe 63, and a sealing coupler 641 rotatably coupling the nozzle 64 with an upper end portion of the central hollow shaft 331 of the upwardly-drafting propeller 33 for allowing a free rotation of the central hollow shaft 331 of the upwardly-drafting propeller 33 and also for sealing the hollow shaft 331 and the feeding pipe 63 for preventing leakage of reinforcing material 5 therefrom and also preventing air entrance in the closed system of this invention.

There is an aperture provided between the nozzle 64 and the hollow shaft 331 to prevent clustering of fine reinforcing material 5 when fed into the bucket 31 through the hollow shaft 331.

The charger 6 may be provided with a boosting or pressurizing system for helping the feeding of reinforcing material 5 into the bucket 31.

Any parts contacted with the molten metal solution of high temperature may be coated with a protective coating such as an alumina coating for its well resistance to heat.

The vortex agitator 32 may also be mounted at a central portion of the systematic equipment in alignment with the longitudinal center 300 of the two propellers 33, 34, not limited in this invention.

A process for making the metal-matrix composite of the present invention by using the closed systematic equipment as aforementioned is now described hereinafter.

The process for making the metal-matrix composite of the present invention comprises the following steps:

1. A metal or metal matrix 2 such as aluminum or aluminum alloy and a flux are fed in the furnace 1. An inert gas such as nitrogen gas from the inert gas supply means 4 is directed into the furnace for purging the furnace so as to expel air outwardly through the venting pipe 14 which is then closed by closing the venting valve 142. The matrix 2 is then remelted by the aid of flux as fed in the furnace 1.

2. A reinforcing material 5 which may be selected from particulates, short fibers and whiskers of: alumina, silicon nitride, silicon carbide, titanium carbide, zirconium oxide, boron carbide and tantalum carbide, and may have an average particle size of 0.05 μm or even finer, is fed into the bucket 31 through the charger 6. The reinforcing material 5 as filled in the bucket 31 is positioned above the molten metal matrix 2 to be pre-heated and to vaporize the moisture contained in the reinforcing material 5. The height of the bucket 31 is suitably adjusted above the metal to prevent entrance of molten metal into the bucket when the metal is kept at steady state or under vortex agitation.

3. The agitator motor 322 is started to keep a rotational speed at 400–600 rpm to rotate the vortex agitator 32 to produce vortex 22 of the molten metal matrix 2 to enforce a convection of the molten fluid in the furnace 1.

4. The hollow-sleeve driving motor 345 is started to rotate the downwardly-blowing propeller 34 to maintain a rotational speed at 2000–6000 rpm to produce a downwardly forced pressure of the inert gas; and the central-shaft driving motor 335 is started to rotate the upwardly-drafting propeller 33 to have a high rotational speed at 3000–8,000 rpm to produce an upwardly drafted streamflow (D) of inert gas as well as being thermally drafted due to a heat convection in the furnace. The upwardly drafted streamflow of inert gas laden with reinforcing material 5 thereon will be forced downwardly to distribute the reinforcing material into the molten matrix by the downwardly-blowing propeller 34. A gravity of the reinforcing material 5 will also help its descending downwardly into the molten matrix 2. As being stifled by the agitator 32, the reinforcing material 5 will then be homogeneously dispersed and mixed in the molten metal matrix 2 to produce the metal-matrix composites reinforced with the reinforcing material 5 of the present invention.

5. After finishing the refining process, the motors 322, 335 and 345 are switched off, and the feeding and agitating means 3 is upwardly lifted from the furnace 1 to proceed the degassing operation of the composite of the mixed molten solution. The gases existing in the composite will be removed by vacuum suction during the degassing operation.

6. The composite is casted to be an ingot which is then annealed to obtain reinforced composite product of the present invention.

The present invention will be further described in detail with reference to the following examples and drawings accompanied herewith. The examples are provided for describing the process and product of the present invention, not for limiting the present invention.

EXAMPLE 1

An aluminum alloy of 2014 Al is remelted at 700° C. in the furnace 1 as shown in FIG. 1 by adding flux therein under a protective nitrogen atmosphere (once the nitrogen atmosphere is formed, the nitrogen gas supply may be closed for saving production cost). A preheated reinforcing material 5, alpha-phase alumina particulates, 0.3 μm average particle size and 2 weight % in the matrix at 100°–700° C. is fed into the bucket 31.

The agitator 32 is rotated to have a speed of 400 rpm. The agitator shaft 321 may be coated with alumina layer for protection under high temperature of molten solution in the furnace. The driving motors 345, 335 are then started to accelerate the rotation of the downwardly-blowing propeller 34 to be at 2000–4000 rpm and rotate the upwardly-drafting propeller 33 to be at 3000–5000 rpm to forceably distribute the reinforcing material into the molten aluminum alloy.

After all the alumina particulates are fed into the furnace, the central-shaft driving motor 335 is switched off and the speed of agitator 32 is reduced to be 80 rpm for a continuous agitation of 10 minutes. The hollow-sleeve driving motor 345 is then switched off and the feeding and agitating means 3 is removed from the furnace 1 for degassing the refined product which is then casted to form an ingot. The ingot is annealed at 340° C. for two hours for obtaining a composite product of the present invention.

Figure 3:
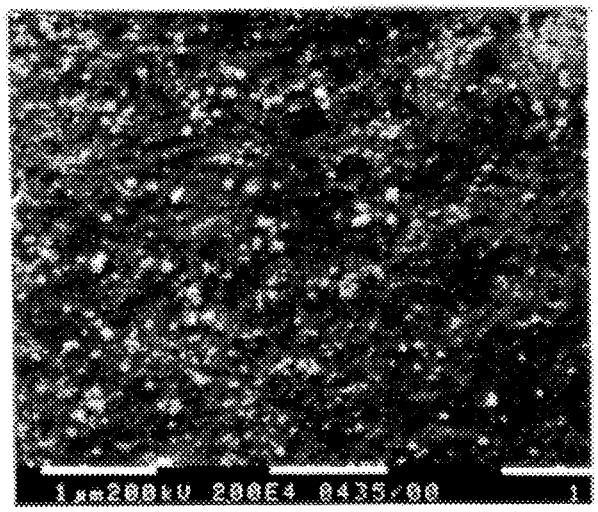
FIG. 3 is a magnified photographic picture of the metal-matrix composite of 2014 Al/0.3 μm $Al_2O_3$ (P) of the present invention as magnified by a scanning electron microscope of $2\times10^4$ times.
Figure 5:
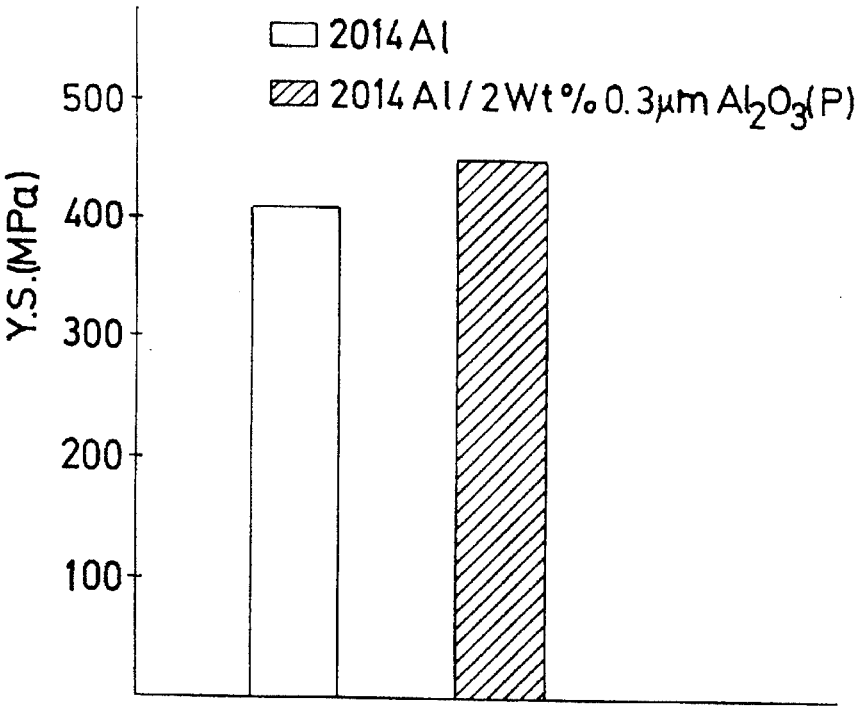
FIG. 5 is a diagram showing a yield strength (Y. S.) of the metal-matrix composite of 2014 Al/0.3 μm $Al_2$ $O_3$ (P) of the present invention in comparison with a strength of single matrix material of 2014 Al.

A microscopic picture of the composite product thus obtained is shown in FIG. 3 to clearly indicate a homogeneous incorporation of the alumina ceramic particulates into the aluminum-alloy matrix. The yield strength (Y. S.) of the composite made by Example 1 is higher than that of the aluminum alloy matrix as shown in FIG. 5, showing an improvement of mechanical property as effected by the present invention.

EXAMPLE 2

The procedures of Example 1 are repeated, except that the matrix is replaced by 6061 Al and the reinforcing material is replaced by alumina particulates of 15 μm particle size and a content of 10 weight % in the matrix. The rotation speed of the upwardly-drafting propeller 33 is adjusted to be at 6000–8000 rpm, while the rotation speed of downwardly-blowing propeller 34 is kept at 4000–6000 rpm.

Figure 4:
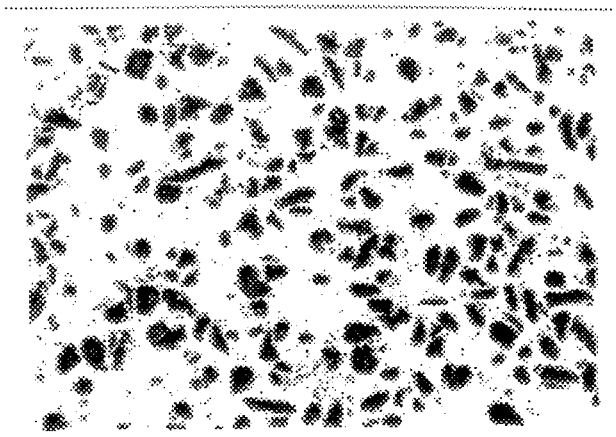
FIG. 4 is a picture of the metal-matrix composite of 6061 Al/15 μm $Al_2$ $O_3$ (P) of the present invention as magnified by an optical microscope of 100 times.
Figure 6:
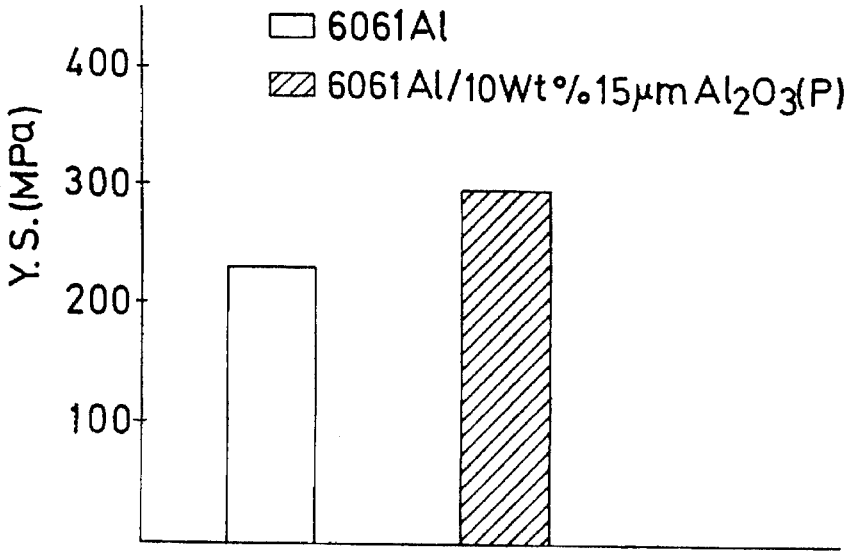
FIG. 6 is a diagram showing a yield strength (Y. S.) of the metal-matrix composite of 6061 Al/15 μm $Al_2$ $O_3$ (P) 10 weight % of the present invention in comparison with the strength of the matrix of 6061 Al.

The finished composite product is shown in FIG. 4, from which, the alumina particulates have been homogeneously incorporated into the aluminum-alloy matrix. As shown in FIG. 6, a mechanical property of yield strength (Y. S.) of the composite product of this invention is superior to that of the aluminum-alloy matrix, thereby denoting an improvement of the present invention.

The present invention is also superior to the U.S. Pat. No. 5,401,338 which is also invented by the same inventor of this application, because the inert gas (nitrogen) is only served for purging the refining chamber 11 in the furnace 1 for forming an inert-gas protective atmosphere in the closed refining system in the furnace 1 and once the inert-gas atmosphere is formed, the inert-gas supply can be stopped during the process, without a continuous and uninterrupted supply of costly inert gas, thereby greatly reducing the production cost and increasing the economic value of this invention.

The present invention may be modified without departing from the spirit and scope of this invention.

I claim:

1. A process for making metal-matrix composite comprising the steps of:

a. providing a closed heating furnace (1); remelting a matrix selected from the group consisting of a metal and a metal alloy under heating in said closed heating furnace (1) for forming a molten matrix (2); providing an inert gas supply means (4) connected to said furnace (1) for purging the furnace (1) by an inert gas from said inert gas supply means (4) to form an inert gas protective atmosphere above the molten matrix (2) within the furnace (1); and mounting a suspending bucket (31) in said furnace (1);

b. providing a feeding and agitating means (3) in said furnace (1), and securing a reinforcing-material charger (6) to a mounting frame (7) for feeding a reinforcing material (5) through said reinforcing-material charger (6) into said bucket (31), suspending said bucket (31) above the molten matrix (2) for preheating the reinforcing material (5) as filled in said bucket (31) above the molten matrix (2);

c. driving said feeding and agitating means (3) for forming a vortex in said molten matrix (2), for upwardly drafting the reinforcing material (5) from said bucket (31) into an upper portion in said furnace (1), and for downwardly forcing said reinforcing material (5) uprisen from said bucket (31) into said molten matrix (2) for homogeneously distributing said reinforcing material (5) into said molten matrix (2) under agitation for obtaining a reinforced metal-matrix composite.

2. A process according to claim 1, wherein the step for providing a closed heating furnace (1) comprises providing a heating furnace (1) which includes a refining chamber (11) surrounded by a heating medium (12) for heating the molten matrix (2) filled in the refining chamber (11), a heat-insulative cover (13 having a cylindrical wall (131) protruding downwardly from the cover (13) to be detachably fastened on a top opening of the refining chamber (11) in the furnace (1), an inlet port (43) of the inert gas supply means (4) formed in the cover (13) for directing the inert gas into the refining chamber (11), and a venting pipe (14) having a venting valve (142) formed thereon and communicating with a discharge port (141) formed in the cover (13) for discharging air outwardly as purged by the inert gas.

3. A process according to claim 1, wherein the step for providing a feeding and agitating means (3) comprises providing a feeding and agitating means (3) which includes: a vortex agitator (32) rotatably mounted on the heat-insulative cover (13) and protruding downwardly to approximate a bottom of the refining chamber (11) for agitating the molten matrix (2) in the furnace (1), an upwardly-drafting propeller (33) rotatably mounted in the furnace (1) and positioned at a central portion of the bucket (31) for upwardly divergently drafting the reinforcing material (5) from the bucket (31), and a downwardly-blowing propeller (34) rotatably mounted in the furnace (1) above the bucket (31) and adjacent to the cover (13) for downwardly forcing the reinforcing material (5) uprisen from the bucket (31) to be homogeneously distributed into the molten matrix (2) in the refining chamber (11) to mix the reinforcing material (5) with the metal matrix as agitated by the vortex agitator (32).

4. A process according to claim 3, wherein the step for providing a feeding and agitating means (3) comprises providing a feeding and agitating means (3) having said vortex agitator (32) including: a plurality of propeller blades radially secured to a lower end of an agitator shaft (321) protruding downwardly to a bottom of the refining chamber (11) from an agitator motor (322) mounted on the cover (13) and through a side hole (134) slotted in the cover (13), and a bushing (323) combined by a pair of semi-cylindrical bands slidably held on a cylindrical wall (131) of the cover (13) for rotatably disposing the agitator shaft (321) in the bushing (323), whereby upon rotation of the vortex agitator (32), a vortex (22) will be formed from a horizontal level (21) of the molten matrix (2) and a heat convection will be formed for efficiently agitating the matrix (2) to be homogeneously mixed with the reinforcing material (5).

5. A process according to claim 1, wherein the step for mounting a suspending bucket (31) in said furnace (1) comprises mounting a bucket (31) generally cylindrical shaped in said furnace (1), said bucket (31) including: an annular shoulder portion (311) having a plurality of suction holes (312) formed in the annular shoulder portion (311) and formed on an upper portion of the bucket (31), a central duct (313) protruding upwardly from the shoulder portion (311) for upwardly guiding an inert gas streamflow laden with reinforcing material (5) thereon when the upwardly-drafting propeller (33) is driven for sucking an inert gas streamflow from each said suction hole (312) inwardly into the bucket (31) to carry the reinforcing material (5) to be laden on the inert gas streamflow and for upwardly drafting the inert gas streamflow carrying the reinforcing material (5) through the central duct (313), and a hanging bracket (30) having a lower bracket portion of the hanging bracket (30) secured with the shoulder portion (311) and having an upper bracket portion of the bracket (30) secured to a suspending sleeve (301) protruding upwardly through the cover (13) and secured to the cover (13) by a fixing bracket (302) fixed on the cover (13).

6. A process according to claim 3, wherein the step for providing a feeding and agitating means (3) comprises providing a feeding and agitating means (3) having said upwardly-drafting propeller (33) including: a plurality of upwardly-curved propeller blades radially secured to a lower shaft end of a central hollow shaft (331) rotatably mounted in a central sleeve hole longitudinally formed through a suspending sleeve (301) of the bucket (31) and having a central feeding passage (332) longitudinally formed through the central hollow shall (331) for communicating with the bucket (31) and a reinforcing-material charger (6), and a central follower pulley (333) secured on an upper portion of the central hollow shaft (331) and coupled to a central-shaft driving motor (335) by a shaft transmission belt (334) wound between the central follower pulley (333) and the central-shaft driving motor (335) which is mounted on the cover (13), whereby upon rotation of the upwardly-drafting propeller (33) as driven by the central-shaft driving motor (335), an inert gas streamflow carrying the reinforcing material (5) will be drafted upwardly and then forced downwardly by the downwardly-blowing propeller (34).

7. A process according to claim 3, wherein the step for providing a feeding and agitating means (3) comprises providing a feeding and agitating means (3) having said downwardly-blowing propeller (34) including: a plurality of downwardly curved propeller blades radially secured to a hollow sleeve (341) having an inner through hole (342) rotatably engageable with a hanging sleeve (301) of the bucket (31) and having an outer sleeve surface of said hollow sleeve (341) rotatably engageable with a central hole (132) formed in the cover (13), with a lower sleeve end (340) rotatably engageable with an upper portion of the hanging bracket (30) of the bucket (31), and a follower pulley (343) secured on an upper portion of the hollow sleeve (341) and coupled to a hollow-sleeve driving motor (345) by a sleeve transmission belt (344) wound between the follower pulley (343) and the hollow sleeve driving motor (345) which is mounted on the cover (13), whereby upon rotation of the downwardly-blowing propeller (34) as driven by the hollow-shaft driving motor (345), an inert gas streamflow carrying the reinforcing material (5) as uprisen from the bucket (31) will be forced downwardly to homogeneously distribute the reinforcing material (5) into the molten matrix (2).

8. A process according to claim 7, wherein the step for providing a feeding and agitating means (3) comprises providing a feeding and agitating means (3) having said hollow sleeve (341) secured with a buffling disk (15) on an upper portion of the hollow sleeve (341) adjacent to the cover (13) and above the propeller blades of the downwardly-blowing propeller (34), having a shallow cylindrical flange (151) bent upwardly to form an inert-gas chamber (152) adjacent to an inlet port (143) of an inert gas supply means (4) for forming a pressurized inert gas atmosphere in the inert-gas chamber (152) for precluding an upward and outward leakage of the reinforcing material (5) from the refining chamber (11) through the central hole (132) in the cover (13).

9. A process according to claim 3, wherein the step for providing a feeding and agitating means (3) comprises providing a feeding and agitating means (3) having the upwardly-drafting propeller (33) and the downwardly-blowing propeller (34) aligned and concentric about a longitudinal axis (300) defining at a longitudinal center of the suspending bucket (31).

10. A process according to claim 7, wherein the step for providing a feeding and agitating means (3) comprises providing a feeding and agitating means (3) having said cover (13) for rotatably mounting said upwardly-drafting propeller (33) and said downwardly blowing propeller (34) on said cover (13) secured on a mounting bracket (71) movably securable to a guiding post (72) of an elevating means (73) of a mounting frame (7).

11. A process according to claim 1, wherein the step for securing a reinforcing-material charger (6) to a mounting frame (7) comprises providing a reinforcing-material charger (6) including a container (61) adjustably mounted by a linking arm member (60) on said mounting frame (7) for storing the reinforcing material (5) therein, a pre-heating device (62) disposed around the container (61) for preheating the reinforcing material (5) stored in the container (61), a feeding pipe (63) protruding downwardly from the container (61) to connect a nozzle (64) secured at a lowest end of the feeding pipe (63), and a sealing coupler (641) rotatably coupling the nozzle (64) with an upper end port,on of a central hollow shaft (331) of a upwardly-drafting propeller (33) for allowing a free rotation of the central hollow shaft (331) of the upwardly-drafting propeller (33) and for sealing the hollow shaft (331) and the feeding pipe (63).

* * * * *